US006780202B2

(12) United States Patent
Shi et al.

(10) Patent No.: US 6,780,202 B2
(45) Date of Patent: Aug. 24, 2004

(54) MODIFICATION OF PRINTED AND DYED MATERIALS

(75) Inventors: Caroline Shi, Allston, MA (US); Sonja Salmon, Raleigh, NC (US); Hui Xu, Wake Forest, NC (US)

(73) Assignee: Novoymes North America, Inc., Franklinton, NC (US)

( * ) Notice: Subject to any disclaimer, the term of this patent is extended or adjusted under 35 U.S.C. 154(b) by 42 days.

(21) Appl. No.: 10/287,135

(22) Filed: Nov. 4, 2002

(65) Prior Publication Data

US 2003/0121111 A1 Jul. 3, 2003

Related U.S. Application Data

(60) Provisional application No. 60/335,691, filed on Nov. 2, 2001.

(51) Int. Cl.[7] ..... D06P 1/16; D06L 1/12

(52) U.S. Cl. ..... 8/137; 8/401; 8/921; 8/922; 8/924; 8/926; 8/927; 8/529; 435/236

(58) Field of Search ..... 8/137, 918–927, 8/529; 435/236

(56) References Cited

U.S. PATENT DOCUMENTS

| | | | | |
|---|---|---|---|---|
| 5,037,662 | A | 8/1991 | Poulose et al. | |
| 5,356,437 | A | 10/1994 | Pedersen et al. | |
| 5,405,414 | A | 4/1995 | Pedersen et al. | |
| 5,478,489 | A | * 12/1995 | Fredj et al. | 510/299 |
| 5,512,203 | A | 4/1996 | Kolattukudy et al. | |
| 5,688,288 | A | 11/1997 | Akatani et al. | |
| 5,885,306 | A | 3/1999 | Hamaya et al. | |
| 5,997,584 | A | 12/1999 | Andersen et al. | |
| 6,048,367 | A | 4/2000 | Damhus et al. | |
| 6,165,960 | A | 12/2000 | Amory et al. | |
| 6,184,010 | B1 | 2/2001 | Riegels et al. | |
| 6,254,645 | B1 | 7/2001 | Kellis, Jr. et al. | |
| 6,258,590 | B1 | 7/2001 | Lange et al. | |

FOREIGN PATENT DOCUMENTS

| | | |
|---|---|---|
| EP | 0 882 084 | 7/1997 |
| WO | WO 99/57360 | 11/1999 |
| WO | WO 00/32697 | 6/2000 |
| WO | WO 01/48304 | 7/2001 |

OTHER PUBLICATIONS

Degani et al., "Potential Use of Cutinase in Enzymatic Scouting of Cotton Fiber Cuticle," App. Biochem and Biotech, vol. 102–103, 277–289 (2002).

* cited by examiner

*Primary Examiner*—Margaret Einsmann
(74) *Attorney, Agent, or Firm*—Elias J. Lambalris

(57) ABSTRACT

The present invention relates to methods and compositions for removing excess dye from dyed and/or printed materials, such as, textile materials dyed with disperse dyes, by treating a dyed or printed material with an esterase. The improvements resulting form the present invention include, for example, improvements in the washfastness, the wetfastness, the crockfastness, sublimation, and/or the quality of the color, such as, brightness, of dyed and/or printed materials. The present invention also relates to methods for printing or dyeing a material by dyeing or printing the material with a combination of a dye that is affected by esterase treatment and a dye that is not affected by esterase treatment, and after dyeing or printing the material, discharging residual dye by treating the material with an esterase.

11 Claims, No Drawings

MODIFICATION OF PRINTED AND DYED MATERIALS

CROSS-REFERENCE TO RELATED APPLICATIONS

This application claims the benefit of U.S. Provisional Application Serial No. 60/335,691 filed Oct. 2, 2001, which is hereby incorporated by reference.

FIELD OF THE INVENTION

The present invention relates to enzymatic methods and compositions for removing excess dye from dyed or printed materials, such as textiles, and to enzymatic methods and compositions for dyeing such materials.

BACKGROUND OF THE INVENTION

A major problem involved with the use of disperse dyes for dyeing or printing of textile materials made from polyester fibers, polyester-containing blends and other fibers and fiber blends, is the tendency of these dyes to aggregate and deposit on the surface of the dyed or printed material. As a result of this residual dye formation, washfastness and wetfastness of the textile material is negatively affected, that is, the unintentional staining of other materials resulting from dyes that migrate from a dyed or printed fabric to another fabric during washing or wetting, often seen when white laundry becomes colored during washing. In addition to washfastness and wetfastness, residual dyes can also undermine the brightness of a shade as well as affect sublimation and crockfastness results of the dyed or printed material.

In order to improve the quality of textile materials, textile manufactures can select dyes that migrate as little as possible during washing. Alternatively, or in addition, textile manufactures can remove excess disperse dyes from newly prepared textiles in post-clearing or after-clearing processes. Traditional after-clearing processes involve repeated water rinses and/or chemical treatments, such as, reduction clearing processes, in which a dyed or printed fiber is treated with a strong alkaline reducing bath, usually containing sodium hydrosulfite and caustic soda. Reduction clearing processes, however, require high temperatures and alkaline conditions, which may damage the fabric and are expensive and time consuming to carry out.

Improvements in removing excess dye from dyed or printed materials, such as textile materials, are therefore desired.

SUMMARY OF THE INVENTION

One aspect of the present invention relates to methods and compositions for removing excess dyes, such as poorly soluble disperse dyes, that aggregate and deposit on the surfaces of dyed and/or printed materials. In accordance with the present invention, improvements to dyed and/or printed materials are obtained by treating a dyed and/or printed material, such as textile materials, paper materials, and films, with an esterase. Improvements resulting form the esterase treatment include, for example, improvements in washfastness, wetfastness, crockfastness, sublimation, and/or color quality (such as, for example, brightness) of dyed and/or printed materials.

Another aspect of the present invention relates to methods for printing or dyeing materials, such as textile materials, paper materials, and films. In accordance with this aspect of the present invention, a material is dyed or printed by dyeing and/or printing the material with a combination of a dye that is affected by esterase treatment and a dye that is not affected by esterase treatment, and after dyeing or printing the material, treating the material with an esterase. In an embodiment of this aspect of the present invention, a dye that is affected by esterase treatment, such as a disperse dye, can be used as a ground shade for a textile material, in combination with a dye, such as an illuminating dye, that is not affected by esterase treatment.

Yet another aspect of the present invention relates to methods for printing or dyeing materials, such as textile materials, paper materials, and films. In accordance with this aspect of the present invention, a combination of materials is dyed or printed by dyeing and/or printing the combination of materials (such as a fiber blend) with a dye that is affected by esterase treatment. In an embodiment of this aspect of the present invention, a dye that is affected by esterase treatment, such as a disperse dye, dyes one portion of the material in the combination, such as polyester, and subsequent to esterase treatment, which in this embodiment changes the affinity characteristics of the dye, the esterase modified residual dye dyes another portion of the material in the combination, such as wool, by virtue of the new affinity characteristics of the modified residual dye. In an embodiment of this aspect of the present invention, two materials with different dyeing properties, such as polyester and wool, are dyed with at least one dye whose affinity characteristics, such as hydrophobic versus ionic, are modified during the dyeing process by treatment with an esterase.

Yet another aspect of the present invention relates to dyed or printed materials, such as, for example, textile materials, paper materials and films prepared by the methods of the present invention.

Although not limited to any one theory of operation, the enzymatic treatment of dyed and/or printed materials according to the present invention is believed to improve the solubility of poorly soluble dyes and/or to decrease the affinity of dyes for materials, thereby improving the removal of excess dyes that aggregate and deposit on the surface of dyed and/or printed materials. In preferred embodiments, the methods of the present invention can eliminate the need for expensive and harsh chemical after-clearing processes, such as the use of heavy metal salts, and significantly reduce water usage.

DETAILED SPECIFICATION OF THE INVENTION

In a preferred embodiment of the invention, excess dye can be removed from dyed or printed materials, such as textile materials, paper materials or films, by treating the printed or dyed material with at least one esterase. Textile materials include, for example, fabrics, yarn, fiber, and garments. The textile materials can be made from synthetic materials, and blends of natural and synthetic materials.

Preferably, blends of natural and synthetic materials comprise at least 20%, more preferably at least 40%, even more preferably at least 60%, most preferably at least 80%, and in particular at least 95% of a synthetic material. Examples of synthetic materials, include, for example, modified cellulose (e.g. acetate, diacetate and triacetate), polyamide (e.g. nylon 6 and 6,6), polyester (e.g., poly(ethylene terephthalate)), acrylic/polyacrylic, and polyurethane (e.g., spandex). Examples of natural materials, include, for example, regenerated cellulosics (e.g., rayon), solvent spun cellulosics (e.g., lyocel and tencel), natural cellulosics (e.g., cotton, flax, linen, and ramie) and proteins (e.g., wool and silk). The term "synthetic" as used herein is intended to mean non-naturally occurring or man-made. Films include synthetic films, such as films made of polymers, such as, modified cellulose, polyamide, polyethylene and polypropylene. Paper materials include paper made from natural and synthetic materials.

In a preferred embodiment, the present invention is used to remove dyes and dye intermediates, which contain at least one ester chemical group and can be hydrolyzed by an esterase. Generally, after dyeing or printing a material, such as a textile material, excess dye is present as an aggregate or deposit on the surface of the dyed and/or printed material. The methods of the present invention can be used to remove this excess dye. Dye present inside the material, such as inside a textile material, is protected or generally protected from the enzyme treatment process. Although not limited to any one theory of operation, it is believed that esterase treatment of dyed and/or printed material results in removal of excess dye by improving the solubility of the dye and/or reducing the affinity of the dye for the material in accordance with or similar to the following non-limiting reaction scheme:

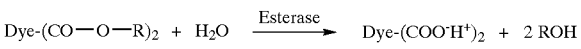

$$\text{Dye-(CO—O—R)}_2 + H_2O \xrightarrow{\text{Esterase}} \text{Dye-(COO}^-\text{H}^+)_2 + 2\,\text{ROH}$$

In a preferred embodiment, the present invention is directed to the use of esterases to remove excess disperse dyes from dyed and/or printed materials. Disperse dyes are typically nonionic compounds that have very limited solubility in water, and usually contain at least one ester group, such as an acetyl group, —O—CO—$CH_3$. Disperse dyes include, for example, azo dyes (such as, for example, mono-ester azo, diester azo and other ester azo dyes) and benzo difuranone dyes. Non-limiting examples of disperse dyes include, for example, Disperse Blue 79 (AAKASH Chemicals and Dyestuffs), Dispersol Red C-4G (BASF), Dispersol Brown C-3G (BASF), Dispersol Blue XF 55 (BASF), Disperse Red 167 (AAKASH Chemicals and Dyestuffs), Dispersol Brilliant Red D-SF (BASF), Dianix Scarlet SE-3G (DyStar).

As used in accordance with the present invention, an "esterase" refers to an enzyme which is able to hydrolyze an ester bond. More preferably, an esterase is a carboxylic ester hydrolase, such as, for example, cutinase, lipase, and carboxylesterase. Non-limiting examples of esterases suitable for use in the present invention include: arylesterase, triacylglycerol lipase, acetylesterase, acetylcholinesterase, cholinesterase, tropinesterase, pectinesterase, sterol esterase, chlorophyllase, L-arabinonolactonase, gluconolactonase, uronolactonase, tannase, retinyl-palmitate esterase, hydroxybutyrate-dimer hydrolase, acylglycerol lipase, 3-oxoadipate enol-lactonase, 1,4-lactonase, galactolipase, 4-pyridoxolactonase, acylcarnitine hydrolase, aminoacyl-tRNA hydrolase, D-arabinonolactonase, 6-phosphogluconolactonase, phospholipase A1,6-acetylglucose deacetylase, lipoprotein lipase, dihydrocoumarin lipase, limonin-D-ring-lactonase, steroid-lactonase, triacetate-lactonase, actinomycin lactonase, orsellinate-depside hydrolase, cephalosporin-C deacetylase, chlorogenate hydrolase, alpha-amino-acid esterase, 4-methyloxaloacetate esterase, carboxymethylenebutenolidase, deoxylimonate A-ring-lactonase, 2-acetyl-1-alkylglycerophosphocholine esterase, fusarinine-C ornithinesterase, sinapine esterase, wax-ester hydrolase, phorbol-diester hydrolase, phosphatidylinositol deacylase, sialate O-acetylesterase, acetoxybutynylbithiophene deacetylase, acetylsalicylate deacetylase, methylumbelliferyl-acetate deacetylase, 2-pyrone-4,6-dicarboxylate lactonase, N-acetylgalactosaminoglycan deacetylase, juvenile-hormone esterase, bis(2-ethylhexyl) phthalate esterase, protein-glutamate methylesterase, 11-cis-retinyl-palmitate hydrolase, all-trans-retinyl-palmitate hydrolase, L-rhamnono-1,4-lactonase, 5-(3,4-diacetoxybut-1-ynyl)-2,2'-bithiophene deacetylase, fatty-acyl-ethyl-ester synthase, xylono-1,4-lactonase, N-acetylglucosaminylphosphatidylinositol deacetylase, cetraxate benzylesterase, acetylalkylglycerol acetylhydrolase, and acetylxylan esterase.

The selection of an esterase for use in the treatment is generally based on the type of dye or dyes which were used to dye or print the material and the specificity of a particular esterase for a dye or dyes, such as, the type of ester bond the esterase hydrolyzes. The esterase treatment of the present invention can involve treatment with a single type of esterase, such as a cutinase, or treatment with one or more esterases, such as two or more esterases, three or more esterases, etc., for example, the combination of a cutinase and a lipase or the combination of various types of lipases. The selection of an esterase can also be based on the conditions of the treatment process, such as, for example, pH and temperature, by selecting an esterase that works best under the process conditions. In a preferred embodiment, the esterase is a lipase (triacylglycerol ester hydolyases), a cutinase, a suberinase, a carboxylicesterase or combinations thereof. A preferred lipase is *Candida antarctica* Lipase B (available from Novozymes A/S). A preferred cutinase is the fungal cutinase derived from *Humicola insolens* (available from Novozymes A/S). In a more preferred embodiment, the esterase is a carboxylesterase. Carboxylesterases have wide specificity, and can therefore be used in removing or discharging a wide variety of disperse dyes. A particularly preferred carboxylesterase is the porcine liver carboxylesterase (available from Sigma).

The esterase may be derived or obtained from any origin, including, bacterial, fungal, yeast or mammalian origin. The term "derived" means in this context that the enzyme may have been isolated from an organism where it is present natively, i.e. the identity of the amino acid sequence of the enzyme are identical to a native enzyme. The term "derived" also means that the enzymes may have been produced recombinantly in a host organism, the recombinant produced enzyme having either an identity identical to a native enzyme or having a modified amino acid sequence, e.g. having one or more amino acids which are deleted, inserted and/or substituted, i.e., a recombinantly produced enzyme which is a mutant and/or a fragment of a native amino acid sequence or an enzyme produced by nucleic acid shuffling processes known in the art. Within the meaning of a native enzyme are included natural variants. Furthermore, the term "derived" includes enzymes produced synthetically by, e.g., peptide synthesis. The term "derived" also encompasses enzymes which have been modified e.g. by glycosylation, phosphorylation, or by other chemical modification, whether in vivo or in vitro. The term "obtained" in this context means that the enzyme has an amino acid sequence identical to a native enzyme. The term encompasses an enzyme that has been isolated from an organism where it is present natively, or one in which it has been expressed recombinantly in the same type of organism or another, or enzymes produced synthetically by, e.g., peptide synthesis. With respect to recombinantly produced enzymes the terms "obtained" and "derived" refers to the identity of the enzyme and not the identity of the host organism in which it is produced recombinantly.

The esterase may also be purified. The term "purified" as used herein covers esterase enzymes free from other components from the organism from which it is derived. The term "purified" also covers esterases free from components from the native organism from which it is obtained. The esterases may be purified, with only minor amounts of other proteins being present. The expression "other proteins" relate in particular to other enzymes. The term "purified" as used herein also refers to removal of other components, particularly other proteins and most particularly other enzymes present in the cell of origin of the esterase. The esterase may be "substantially pure," that is, free from other components from the organism in which it is produced, that is, for example, a host organism for recombinantly produced esterases. In preferred embodiment, the esterases are at least 75% (w/w) pure, more preferably at least 80%, at least 85%, at least 90%, at least 95%, at least 96%, at least 97%, at least 98%, or at least 99% pure. In another preferred embodiment, the esterase is 100% pure.

The term esterase also includes any auxiliary compounds or conditions to assist the enzyme's catalytic activity, which may or may not be naturally present in the reaction system.

The esterase may be in any form suited for the use in the treatment process, such as e.g. in the form of a dry powder or granulate, a non-dusting granulate, a liquid, a stabilized liquid, or a protected enzyme. Granulates may be produced, e.g. as disclosed in U.S. Pat. Nos. 4,106,991 and 4,661,452, and may optionally be coated by methods known in the art. Liquid enzyme preparations may, for instance, be stabilized by adding stabilizers such as a sugar, a sugar alcohol or another polyol, lactic acid or another organic acid according to established methods. Protected enzymes may be prepared according to the method disclosed in EP 238,216.

The removal of excess disperse dye from dyed and/or printed materials, according to the present invention, can be carried out by any suitable method available in the art. Preferably, removal comprises contacting, rinsing or washing of a dyed and/or printed material with an aqueous rinse liquor or wash comprising at least one esterase. The removal of excess dye may be carried out at any time after the dyeing and/or printing process, including, for example, immediately following the dyeing or printing of the material, such as on a newly dyed and/or newly printed textile material, or following additional processing steps. The removal of excess dye according to the present invention is preferably performed in a batch mode or continuous mode.

The removal of excess disperse dyes from dyed and/or printed textile material, according to the present invention, can be carried out using any suitable equipment available in the art for after-clearing processes. The processes of the present invention may preferably be applied in a winch, a beck, a jet dyer, an open-width washing machine, a J or U box, a steamer, or any other equipment suitable for rinsing or washing materials.

The treatment with an esterase may be carried out at conditions chosen to suit the selected enzymes according to principles well known in the art. It will be understood that each of the reaction conditions, such as, e.g., concentration/dose of enzyme, pH, temperature, and time of treatment, may be varied, depending upon, e.g., the source of the enzyme, the type of dye, the method in which the treatment is performed, the extent of excess dye removal desired. It will further be understood that optimization of the reaction conditions may be achieved using routine experimentation by establishing a matrix of conditions and testing different points in the matrix.

Preferably, the temperatures, pH, treatment time and concentration are based on the optimal conditions for the enzyme or enzymes used. Preferably, the reaction mixture of the material, for example, a textile, and enzyme is incubated or reacted at a temperature of between about 25–100° C., more preferably between about 50–70° C. Preferably, the reaction time is between about 1–120 minutes, more preferably about 10–40 minutes. The enzymatic treatment may be conducted at any suitable pH, such as for example, in the range of about 4 to about 11, such as, at a pH of about 6 to about 8.

The esterases are added in an effective amount. The term "effective amount" means an amount sufficient to achieve the desired effect. Preferably, the esterases are added in an amount from about 0.1 mg enzyme protein to about 1000 mg/L liquor, more preferably in an amount from about 1 to 500 mg/L, such as, 1 mg to about 200 mg/L, such as, 80 to about 100 mg/L.

The present invention also relates to methods for printing or dyeing materials, such as textile materials, paper materials and films, using the combination of at least one dye that is affected by esterase treatment and at least one dye that is not affected by esterase treatment, and after dyeing or printing the material, treating the material with an esterase. The phase "affected by esterase treatment" means that the solubility of the dye is increased by treatment with an esterase and/or the affinity of the dye for the material is decreased by treatment with an esterase and/or the dye can be discharged or loosed from a material, such as a polyester textile material, by treatment with an esterase. In a preferred embodiment of this aspect of the present invention, a textile material is dyed and/or printed with a dye that is affected by esterase treatment and a dye that is not affected by esterase treatment, and following dyeing, the dyed and/or printed material is treated with an esterase to discharge the excess disperse dye. In another preferred embodiment, the dye that is affected by esterase treatment, as described herein, can be used as a ground shade for a dyed and/or printed textile material, such as, by dyeing the textile material with a combination of a disperse dye and a dye that is not affected by esterase treatment, such as an illuminating dye, and following dyeing, subjecting the dyed and/or printed material to an esterase treatment, as described herein. Examples of dyes which are generally not affected by esterase treatment include, for example, an AQ or mono-azo type dye which do not contain at least one ester bond The present invention further includes textile materials, such as, for example, fabrics, yarn, fiber, garments, paper materials and films, prepared by the methods described herein. The materials may also be subject to additional processes. For example, for textile materials, the preparation may include the application of finishing techniques, and other treatment processes, such as imparting antimicrobial properties (e.g., using quaternary ammonium salts), flame retardancy (e.g., by phosphorylation with phosphoric acid or urea), increasing absorbency (by coating or laminating with polyacrylic acid), providing an antistatic finish (e.g., using amphoteric surfactants (N-oleyl-N,N-dimethylglycine)), providing a soil release finish (e.g., using NaOH), providing an antisoiling finish (e.g., using a fluorochemical agent), and providing an antipilling finish (e.g., using NaOH, alcohol).

The invention will further be described by reference to the following detailed examples. These examples are provided for the purpose of illustration only, and are not intended to be limiting unless otherwise specified.

EXAMPLES

Example 1

Disperse Dyeing of Polyester Fabric Followed by an Enzymatic Clearing Process Knitted, bleached 100% knit polyester (Polyester fabric: 100% Textured Dacron Knit, supplied by Testfabrics, Inc.) was dyed in a Mathis Labomat machine (Werner Mathis AG in Switzerland) under the following conditions:

| | |
|---|---|
| Dyestuff: | 4.0% o.w.g. Dispersol Red C-4G<br>Dispersol Red C-4G is a product of BASF. |
| EDTA: | 0.5 g/L (chelating agent) |
| Sodium acetate: | 2 g/L (dyebath pH control at 4.5) |

The dyeing process started by cold addition of EDTA, sodium acetate, dyestuff and fabric. The dyebath was preheated to 60° C. at 3.5° C./min and circulating for 10 minutes. Thereafter, the temperature was raised at 1.5° C./min to 130° C., where the dyeing process was carried out for 30 min.

Upon the completion of dyeing process, the dyebath was rapidly cooled down to 70° C. followed by draining off the dyeing liquor. A 10 min. warm rinse (at 50° C.) was given prior to the afterclearing step.

The afterclearing process was performed under the following conditions:

| | |
|---|---|
| Buffer: | 20 mM, pH 8 phosphate buffer; |
| Fabric: | 20 mL/g fabric; |
| Enzyme: | 62.5 mg cutinase per liter of bath (protein-engineered *H. insolens* cutinase available from Novozymes A/S) |

Rinsing was carried out for 20 minutes at 70° C. Following the rinsing process, the rinse liquor was drained. The fabric was squeezed and dried.

The washfastness was determined according to AATCC TM 61-2A, 1996. Staining was evaluated using AATCC Chromatic Transference Scale. The degree staining/color transfer are graded by 1~5, with 1 being the heaviest color transfer (meaning the worst washfastness properties) and 5 being no color transfer (meaning excellent washfastness properties).

The staining evaluation grades were found to be 5 (silk), 5(Nylon) and 5(Acetate), which means that there was no color transfer during wash test and fabric demonstrated excellent washfastness properties.

Example 2

Disperse Dyeing of Polyester Fabric Followed by Conventional Chemical Reduction Clearing The dyeing process was carried out as described in Example 1. The afterclearing process was conducted as follows:

Addition of 2 g/L sodium hydroxide and 2 g/L sodium hydrosulfite in fresh softened water;

10 mL/g fabric.

Raising rinse bath temperature to 70° C.

Rinsing 20 minutes at 70° C.

Draining the rinse liquor.

Refilling and neutralizing with 0.5–1 g/L acetic acid.

The fabric was squeezed and dried. The washfastness was determined according to AATCC TM 61-2A, 1996. Staining was evaluated using AATCC Chromatic Transference Scale. The degree staining/color transfer are graded by 1~5, with 1 being the heaviest color transfer (meaning the worst washfastness properties) and 5 being no color transfer (meaning excellent washfastness properties).

The staining evaluation grades were found to be 3.5 (silk), 4.0 (Nylon) and 4.0 (Acetate), which means that there was light color transfer during wash test and fabric demonstrated fairly good washfastness properties.

Example 3

Disperse Dyeing of Polyester Fabric Followed by Alkaline Clearing

The dyeing process was carried out as described in Example 1. The alkaline clearing process was conducted as follows:

Addition of 3 g/L sodium hydroxide in fresh softened water; 10 mL/g fabric.

Raising rinse bath temperature to 70° C.

Rinsing 20 minuts at 70° C.

Draining the rinse liquor.

Refilling and neutralizing with 0.5~1 g/L acetic acid.

The fabric was squeezed and dried. The washfastness was determined according to AATCC TM 61-2A, 1996. Staining was evaluated using AATCC Chromatic Transference Scale. The degree staining/color transfer are graded by 1~5, with 1 being the heaviest color transfer (meaning the worst washfastness properties) and 5 being no color transfer (meaning excellent washfastness properties).

The staining evaluation grades were found to be 3.0 (silk), 3.5 (Nylon) and 3.5 (Acetate), which means that there was moderate color transfer during wash test and fabric demonstrated fair washfastness properties.

Example 4

Esterase Modification of Water Insoluble Disperse Dyes in Solution-Mechanism I: Hydrolysis of Ester Groups, Significant Increase in Dye Solubility, Intact Chromophore The commercial disperse dyes tested were Dispersol Red C-4G, Dispersol Brown C-3G, Dispersol Blue XF55, Disperse Red 167 and Dispersol Brilliant Red D-SF. 5 mg/ml dye stock (suspension in 20 mM pH 8 phosphate buffer) was made for each commercial dye. Since the absorbance of an opaque dye suspension cannot be detected by UV-vis spectrometer, these fives dyes were dissolved in acetone in the concentration of 50~100 mg/L and the absorbance of each dye solution was measured as reference (see Table 1). Dispersol Red C-4G, Dispersol Brown C-3G, Dispersol Blue XF55 dyed fabrics were treated with a cutinase or NaOH (as a comparison), as follows.

Esterase treatment: 100 μL stock solutions of Dispersol Red C-4G, Dispersol Brown C-3G, Dispersol Blue XF55 were further diluted by 10 mL 20 mM pH 8 phosphate buffer in test tubes, which were then placed in a waterbath set at 70° C. After 10 min. preheating in waterbath, each sample was dosed with 62.5 mg/L cutinase and incubated for 10 min. The samples were then taken out for UV-vis measurement.

Alkaline treatment: 100 μL stock solutions of Dispersol Red C-4G, Dispersol Brown C-3G, Dispersol Blue XF55 were further diluted by 10 mL 3 g/L NaOH stock in test tubes, which were then placed in a in waterbath set at 70° C. and incubated for 20 min. The samples were then taken out for UV-vis measurement. This procedure was repeated for the alkaline treatment at 80° C.

UV-vis Absorbance Evaluation: Because of ester hydrolysis during cutinase or alkaline treatment, the original cloudy suspension changed to a translucent solution, the absorbance of which can be measured in a HP 8453 UV-vis spectrophotometer. The absorbance data and curves of the solutions treated with cutinase or NaOH are summarized in Table 2.

Table 2 shows that for these three dyes, cutinase treated solution gave higher absorbance than NaOH treated (either at 70° C. or 80° C.). This means that cutinase converted more dyes into soluble forms than did NaOH.

TABLE 1

Absorbance (in acetone) of different disperse dyes in acetone.

| Commercial Name | Dye concentration (mg/l) | Chemistry | λ_max (nm) | Abs @ λ_max (nm) |
|---|---|---|---|---|
| Dispersol Red C-4G | 50 | azo-di-ester | 496 nm | 0.9724 |
| Dispersol Brown C-3G | 50 | azo-di-ester | 423 nm | 0.9258 |
| Dispersol Blue XF 55 | 50 | azo-di-ester | 610 nm | 0.5235 |
| Disperse Red 167 | 50 | azo-di-ester | 512 nm | 1.2251 |
| Dispersol Brilliant Red D-SF | 100 | benzodi-furanone | 517 nm | 1.1794 |

TABLE 2

Absorbance (in water) of some disperse dyes treated cutinase or sodium hydroxide.

| Commercial Name | λ_max (nm) | Cutinase Treated (70 C.) Abs @ λ_max (AU) | NaOH Treated (70 C.) Abs @ λ_max (AU) | NaOH Treated (80 C.) Abs @ λ_max (AU) |
|---|---|---|---|---|
| Dispersol Red C-4G [Dye] = 50 mg/L | 512 nm | 0.9291 | 0.8650 | 0.8921 |
| Dispersol Brown C-3G [Dye] = 50 mg/L | 462 nm | 1.1046 | 0.9451 | 1.0205 |
| Dispersol Blue XF 55 [Dye] = 50 mg/L | 618 nm | 0.3069 | 0.0504 | 0.0031 |

Example 5

Cutinase Modification of Water Insoluble Disperse Dyes in Solution-Mechanism II: Hydrolysis of Ester Groups, Partial Increase in Dye Solubility, Altered Chromophore Disperse Red 167 was selected for this example. The procedures of cutinase and NaOH treatment, and UV-vis evaluation were described in Example 4. The absorbance data and curves of the solutions treated with cutinase or NaOH are summarized in Table 3.

Table 3 shows that the absorbance of the cutinase treated resulted in an increase in dye solubility.

TABLE 3

Absorbance (in water) of Disperse Red 167 treated cutinase or sodium hydroxide.

| Commercial Name | λ_max (nm) | Cutinase Treated (70 C.) Abs @ λ_max (AU) | NaOH Treated (70 C.) Abs @ λ_max (AU) | NaOH Treated (80 C.) Abs @ λ_max (AU) |
|---|---|---|---|---|
| Disperse Red 167 [Dye] = 50 mg/L | 480 nm | 0.4249 | # | # |

Note:
#: Means absorbance was not detectable by UV-vis spectrometer due to the turbidity of the suspension.

Example 6

Cutinase Modification of Water Insoluble Disperse Dyes in Solution-Mechanism III: Hydrolysis of Ester Groups Leading to Destroyed Chromophore, Increased Dye Solubility Disperse Brilliant Red D-SF was selected for this example. The procedures of cutinase and NaOH treatment, and UV-vis evaluation were described in Example 4. The absorbance data and curves of the solutions treated with cutinase or NaOH are summarized in Table 4.

Results in Table 3 show that the absorbance data of both the cutinase treated and NaOH (at 80° C.) treated samples were one fourth of that measured in acetone, but the reaction solutions were transparent, indicating that the dye was solubilized and the chromophore was destroyed.

TABLE 4

Absorbance Dispersol Brilliant Red D-SF treated cutinase or sodium hydroxide.

| Commercial Name | λ_max (nm) | Cutinase Treated (70 C.) Abs @ λ_max (AU) | NaOH Treated (70 C.) Abs @ λ_max (AU) | NaOH Treated (80 C.) Abs @ λ_max (AU) |
|---|---|---|---|---|
| Dispersol Brilliant Red D-SF [Dye] = 100 mg/L | 412 nm | 0.2979 | 0.4599 | 0.2315 |

Example 7

Modification of Water Insoluble Disperse Dyes by Lipases and Esterases

In this example, six different enzymes with ester hydrolytic activity were examined for their activities towards disperse dyes with azo-di-ester or benzo difuranone structure. Dispersol Red C-4G and Dispersol Brilliant Red D-SF were selected for this example. The procedures of enzyme treatment and UV-vis evaluation were described in Example 4. If the enzyme is capable of hydrolyze the dye with ester groups and the hydrolyzed product has enough solubility in water, the absorbance of the dye solution enzyme treated can be detected spectrometrically.

The absorbance data of the solutions treated with different enzymes alone with the enzyme information are summarized in Table 5.

The absorbance data in Table 5 shows lipase B demonstrated outstanding performance, comparable to that of cutinase in example 4 and 6. Treatment with pectin methyl esterase and pectin acetyl esterase also resulted in substantial increases in dye solubility.

TABLE 5

Absorbance of dye solutions treated with different type of lipases and esterases.

| Stain | Enzyme type (Optimal Condition) | Dispersol Red C-4G azo-di-ester, 50 ml/l λ_max = 512 nm | Dispersol Brilliant Red D-SF benzo difuranone, 100 mg/l λ_max = 412 nm |
|---|---|---|---|
| Blank | — | 0 | 0 |
| Lipase B Candida Antarctica B | Fungal lipase (pH 7, 40 C.) | 0.9428 | 0.3025 |
| Pectin Methyl Esterase Aspergillus | Fungal pectin methyl (pH 6, 40 C.) | 0.4676 | 0.4325 |
| Pectin Acetyl Esterase *Bacills subtillis* | Bacterial pectin acetyl (pH 6, 40 C.) | 0.5659 | 0.4280 |
| Cutinase *Humicola insolens* (Example 4 and 6) | Fungal esterase (pH 8, 70 C.) | 0.9291 | 0.2979 |

What is claimed is:

1. A process for removing excess dye from a dyed or printed textile material which has been dyed or printed with a disperse dye having at least one ester group, comprising treating a dyed or printed material with a wash liquor comprising an esterase wherein the ester bond of the disperse dye is hydrolyzed by said esterase.

2. The process of claim 1, wherein the esterase is a cutinase.

3. The process of claim 1, wherein the esterase is a lipase.

4. The process of claim 1, wherein the esterase is a carboxylesterase.

5. The process of claim 1, wherein in the esterase is a cutinase, a lipase, a carboxylesterase or combinations thereof.

6. The process of claim 1, wherein the textile material comprises of one or more of the following synthetic materials: modified cellulose, polyamide, polyester, acrylic, polyacrylic, and polyurethane.

7. The process of claim 1, wherein the textile material is a blend of a synthetic material and a natural material.

8. The process of claim 7, wherein the natural material is one or more of the following natural materials: regenerated cellulosics, solvent spun cellulosics, natural cellulosics, and proteins.

9. The process of claim 1, wherein the textile material comprises polyester.

10. The process of claim 1, wherein the disperse dye is an ester azo dye or a benzo difuranone dye.

11. A textile material prepared by the process of claim 1.

* * * * *